US009647396B2

(12) United States Patent
Tsai et al.

(10) Patent No.: US 9,647,396 B2
(45) Date of Patent: May 9, 2017

(54) STANDING-TYPE ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Rui Su, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/229,622

(22) Filed: Aug. 5, 2016

(65) Prior Publication Data

US 2017/0040749 A1 Feb. 9, 2017

(30) Foreign Application Priority Data

Aug. 7, 2015 (CN) ..... 2015 1 0477983

(51) Int. Cl.

| | |
|---|---|
| ***H01R 12/00*** | (2006.01) |
| ***H01R 13/6587*** | (2011.01) |
| ***H01R 12/57*** | (2011.01) |
| ***H01R 12/71*** | (2011.01) |
| ***H01R 24/64*** | (2011.01) |
| *H01R 107/00* | (2006.01) |

(52) U.S. Cl.

CPC ..... *H01R 13/6587* (2013.01); *H01R 12/57* (2013.01); *H01R 12/716* (2013.01); *H01R 24/64* (2013.01); *H01R 2107/00* (2013.01)

(58) Field of Classification Search

CPC H01R 13/6587; H01R 2107/00; H01R 12/57; H01R 24/64; H01R 12/716; H01R 12/73; H01R 13/6658; H01R 13/642

USPC ..... 439/83

See application file for complete search history.

(56) References Cited

U.S. PATENT DOCUMENTS

| | | | | |
|---|---|---|---|---|
| 9,537,261 | B2 * | 1/2017 | Chen | H01R 13/642 |
| 2009/0042420 | A1 * | 2/2009 | Zheng | H01R 13/6658 439/83 |
| 2010/0046891 | A1 * | 2/2010 | Sabo | G02B 6/3817 385/74 |

(Continued)

*Primary Examiner* — Jean F Duverne

(74) *Attorney, Agent, or Firm* — Muncy, Geissler, Olds & Lowe, P.C.

(57) ABSTRACT

A standing-type electrical receptacle connector includes a first terminal module, a second terminal module, and a grounding plate that are received in a metallic shell. The first terminal module includes a first insulated member and first receptacle terminals. The second terminal module includes a second insulated member and second receptacle terminals. The first receptacle terminals include first ground terminals, and tail portions of the first ground terminals are extending out of the first insulated member. The second receptacle terminals include second ground terminals, and tail portions of the second ground terminals are extending out of the second insulated member. The grounding plate includes legs each disposed between the corresponding tail portions, each of the legs and the corresponding tail portions are aligned along a vertical line and inserted into the same ground soldering hole of a circuit board. Therefore, the cost for soldering procedure can be reduced.

11 Claims, 11 Drawing Sheets

(56) References Cited

U.S. PATENT DOCUMENTS

2012/0003852 A1* 1/2012 Chang ..... H01R 12/73
439/83

* cited by examiner

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | } 31 |
| GND | RX1+ | RX1− | VBUS | SBU2 | D− | D+ | CC2 | VBUS | TX2− | TX2+ | GND | } 41 |

FIG.11

STANDING-TYPE ELECTRICAL RECEPTACLE CONNECTOR

CROSS-REFERENCES TO RELATED APPLICATIONS

This non-provisional application claims priority under 35 U.S.C. §119(a) on Patent Application No. 201510477983.2 filed in China, P.R.C. on 2015 Aug. 7, the entire contents of which are hereby incorporated by reference.

FIELD OF THE INVENTION

The instant disclosure relates to an electrical receptacle connector, and more particular to a standing-type electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, micro USB interconnects are developed which include advantageous like small occupation volume and ease of portability. Therefore, the micro USB interconnects are widely adopted to smart mobile devices, digital cameras, or other portable electronic devices to mate with connecting cables for data transmission or power supply.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, a grounding plate for shielding is disposed between the upper receptacle terminals and the lower receptacle terminals, and an outer iron shell circularly enclosing the plastic core.

SUMMARY OF THE INVENTION

The upper receptacle terminals include upper tail portions extending out of the plastic core, the lower receptacle terminals include lower tail portions extending out of the plastic core, and the grounding plate includes legs extending out of the plastic core. The upper tail portions, the lower tail portions, and the legs are respectively soldered to different soldering holes of a circuit board. Therefore, the manufacturing of the conventional connector is time consuming. For example, the circuit board has to be processed for several times to form the soldering holes respectively corresponding to the upper tail portion, the lower tail portions, and the legs. In addition, the soldering spots are required to cover the legs, the upper tail portions, and the lower tail portions, so that the legs, the upper tail portions, and the lower tail portions are firmly in contact with the respective soldering holes for conduction. Once any of the soldering holes are not in contact with the legs, the upper tail portions, or the lower tail portions, the transmission of the signal, power, or grounding may be failed.

In view of this, an embodiment of the instant disclosure provides a standing-type electrical receptacle connector. The standing-type electrical receptacle connector comprises a metallic shell, a first terminal module, a second terminal module, and a grounding plate. The metallic shell comprises a receptacle cavity. The first terminal module is received in the receptacle cavity. The first terminal module comprises a first insulated member and a plurality of first receptacle terminals. The first receptacle terminals are held at the first insulated member and at least comprise a plurality of first ground terminals each having a first tail portion. The first tail portions of the first ground terminals are extending out of the first insulated member. The second terminal module is received in the receptacle cavity and combined with the first terminal module. The second terminal module comprises a second insulated member and a plurality of second receptacle terminals The second receptacle terminals are held at the second insulated member and at least comprise a plurality of second ground terminals each having a second tail portion. The second tail portions of the second ground terminals are extending out of the second insulated member. An assembling space is formed between each of the first tail portions and the corresponding second tail portion. The grounding plate is between the first terminal module and the second terminal module. The grounding plate comprises a plate body and a plurality of legs. The plate body is between the first receptacle terminals and the second receptacle terminals. The legs are extending outward from two sides of a rear of the plate body and extending out of the second insulated member. Each of the legs is positioned in the corresponding assembling space. A first leg surface of each of the legs is adjacent to the corresponding first tail portion. A second leg surface of each of the legs is adjacent to the corresponding second tail portion. A cross section portion of each of the legs, a cross section portion of the corresponding first tail portion, and a cross section portion of the corresponding second tail portion are aligned along a vertical line.

In one embodiment, a surface of each of the first tail portions is in contact with the first leg surface of the corresponding leg. In addition, a surface of each of the second tail portions is in contact with the second leg surface of the corresponding leg.

In one embodiment, the surface of each of the first tail portions is spaced from the first leg surface of the corresponding leg by a distance. In addition, the surface of each of the second tail portions is spaced from the second leg surface of the corresponding leg by another distance.

In one embodiment, the standing-type electrical receptacle connector further comprises a circuit board. The circuit board comprises a plurality of ground soldering holes. Each of the ground soldering holes is for the insertion of the corresponding first tail portion, the corresponding second tail portion, and the corresponding leg. The metallic shell comprises an inner shell and a cover plate enclosing the inner shell. The cover plate comprises a plurality of fixing pieces soldered with the circuit board.

In one embodiment, the first terminal module comprises a rear block protruding from a rear of the first insulated member and abutted against a periphery of the metallic shell.

In one embodiment, the second insulated member comprises a tongue portion. Each of the first receptacle terminals comprises a first flat contact portion. Each of the second receptacle terminals comprises a second flat contact portion. The tongue portion has two opposite surfaces. The first flat contact portions and the second flat contact portions are respectively disposed at the two surfaces of the tongue portion.

In one embodiment, the first receptacle terminals further comprise a plurality of first signal terminals and at least one first power terminal. The second receptacle terminals further comprise a plurality of second signal terminals and at least one second power terminal. The tail portions of the first signal terminals, the tail portion of the first power terminal, and the tail portions of the first ground terminals are aligned along a first horizontal line. The tail portions of the second signal terminals, the tail portion of the second power terminal, and the tail portions of the second ground terminals are aligned along a second horizontal line. The vertical line along where the legs, the first tail portions of the first ground terminals, and the second tail portions of the second ground terminals are aligned is substantially perpendicular to the first horizontal line and the second horizontal line.

Based on the above, the tail portion of the ground terminal of the first receptacle terminal, the tail portion of the ground terminal of the second receptacle terminal, and the leg of the grounding plate are adjacent to and drawn close with each other, so that the tail portions and the leg can be inserted into the same ground soldering hole for soldering with the circuit board. Accordingly, the manufacturing of the circuit board can be simplified, and the cost for soldering procedure can be reduced. Moreover, the rear block extending from the rear of the second insulated member can be engaged with the cover plate, so that the cover plate can be positioned with the first insulated member as well as the second insulated member. Additionally, the rear block and the cover plate may be omitted in some embodiments, and the first insulated member and the second insulated member are directly assembled in the inner shell of the metallic shell. Therefore, the manufacturing cost of the connector can be reduced, and the connector can be adapted to different needs.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the standing-type electrical receptacle connector can have a 180 degree symmetrical, dual or double orientation design and pin assignments which enables the standing-type electrical receptacle connector to be mated with a corresponding plug connector in either of two intuitive orientations, i.e. in either upside-up or upside-down directions. Therefore, when an electrical plug connector is inserted into the standing-type electrical receptacle connector with a first orientation, the flat contact portions of the first receptacle terminals are in contact with upper-row plug terminals of the electrical plug connector. Conversely, when the electrical plug connector is inserted into the standing-type electrical receptacle connector with a second orientation, the flat contact portions of the second receptacle terminals are in contact with the upper-row plug terminals of the electrical plug connector. Note that, the inserting orientation of the electrical plug connector is not limited by the standing-type electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 11 illustrates a schematic configuration diagram of the receptacle terminals of the standing-type electrical receptacle connector shown in FIG. 10.

DETAILED DESCRIPTION

Figure 1:
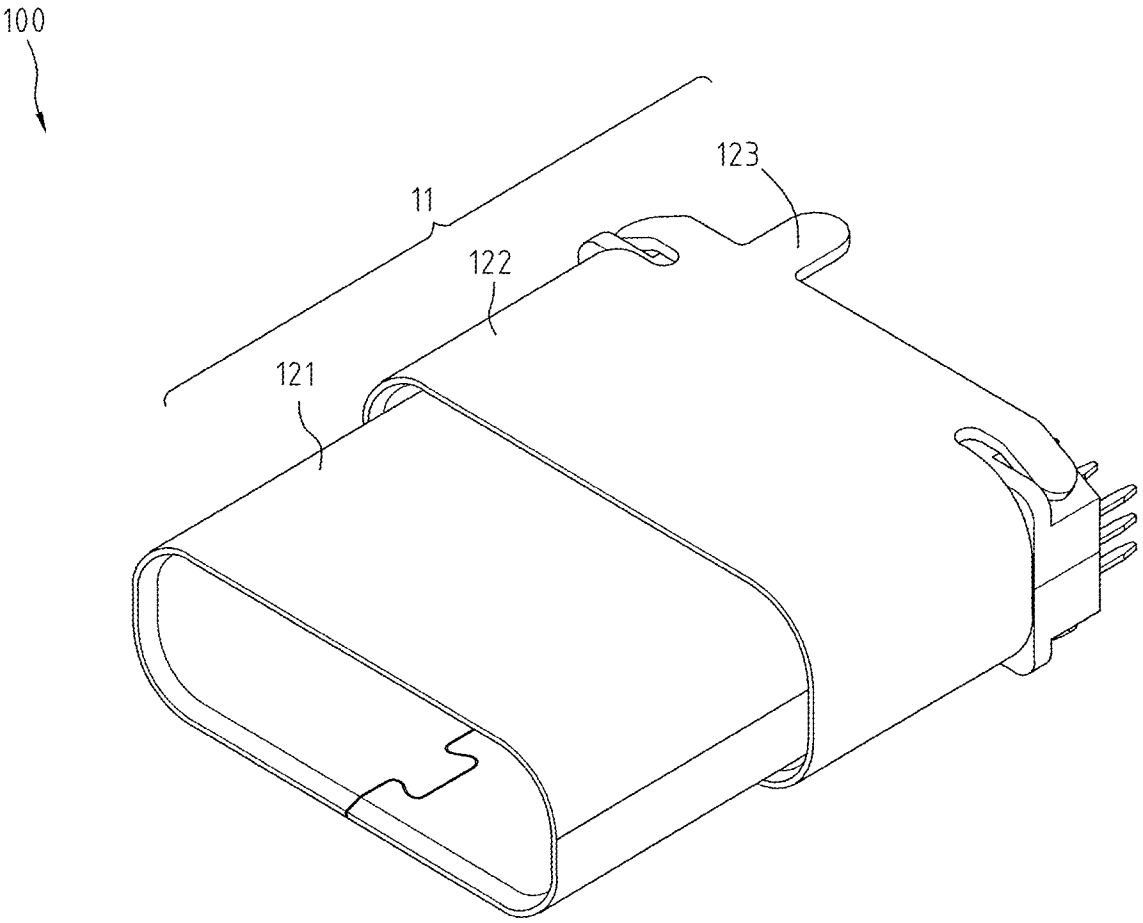
FIG. 1 illustrates a perspective view (1) of a standing-type electrical receptacle connector according to an exemplary embodiment of the instant disclosure.
Figure 2:
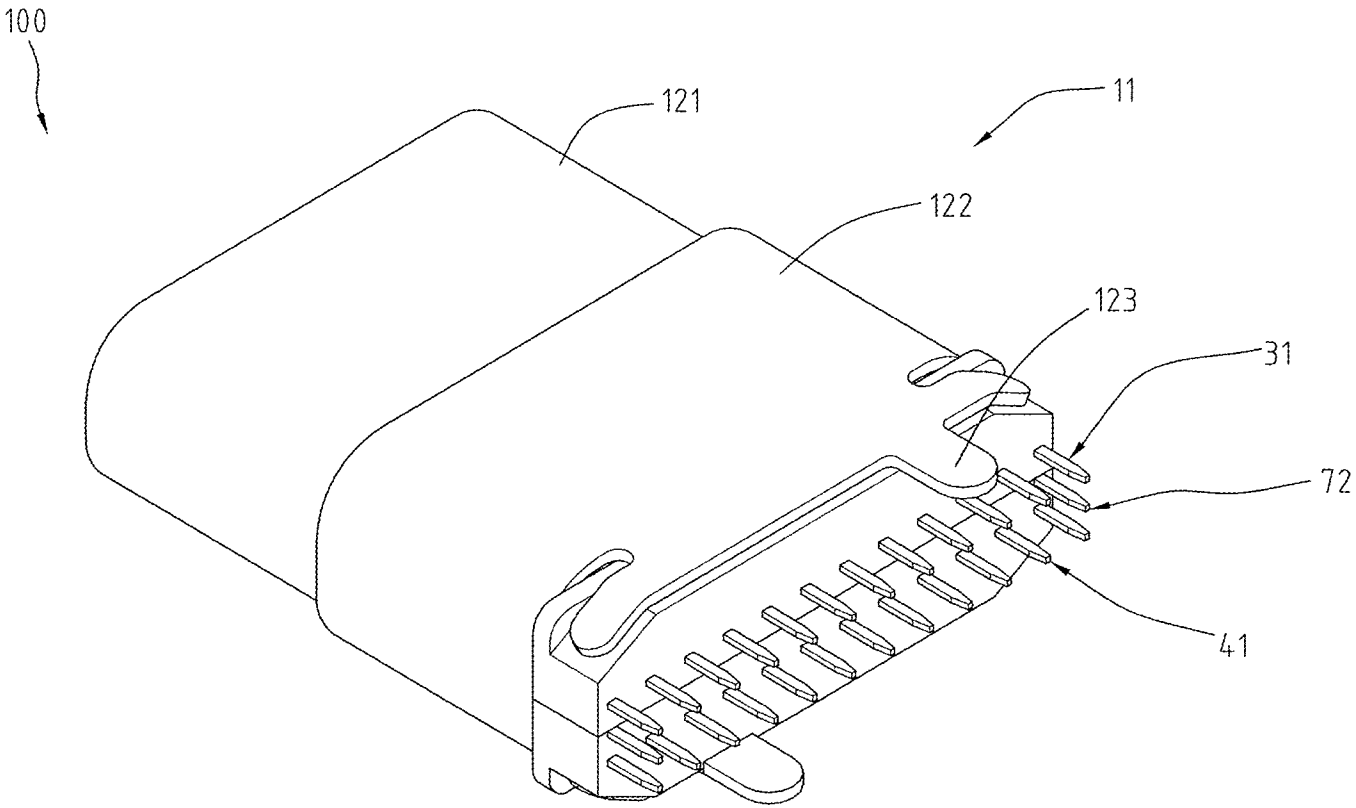
FIG. 2 illustrates a perspective view (2) of the standing-type electrical receptacle connector.
Figure 3:
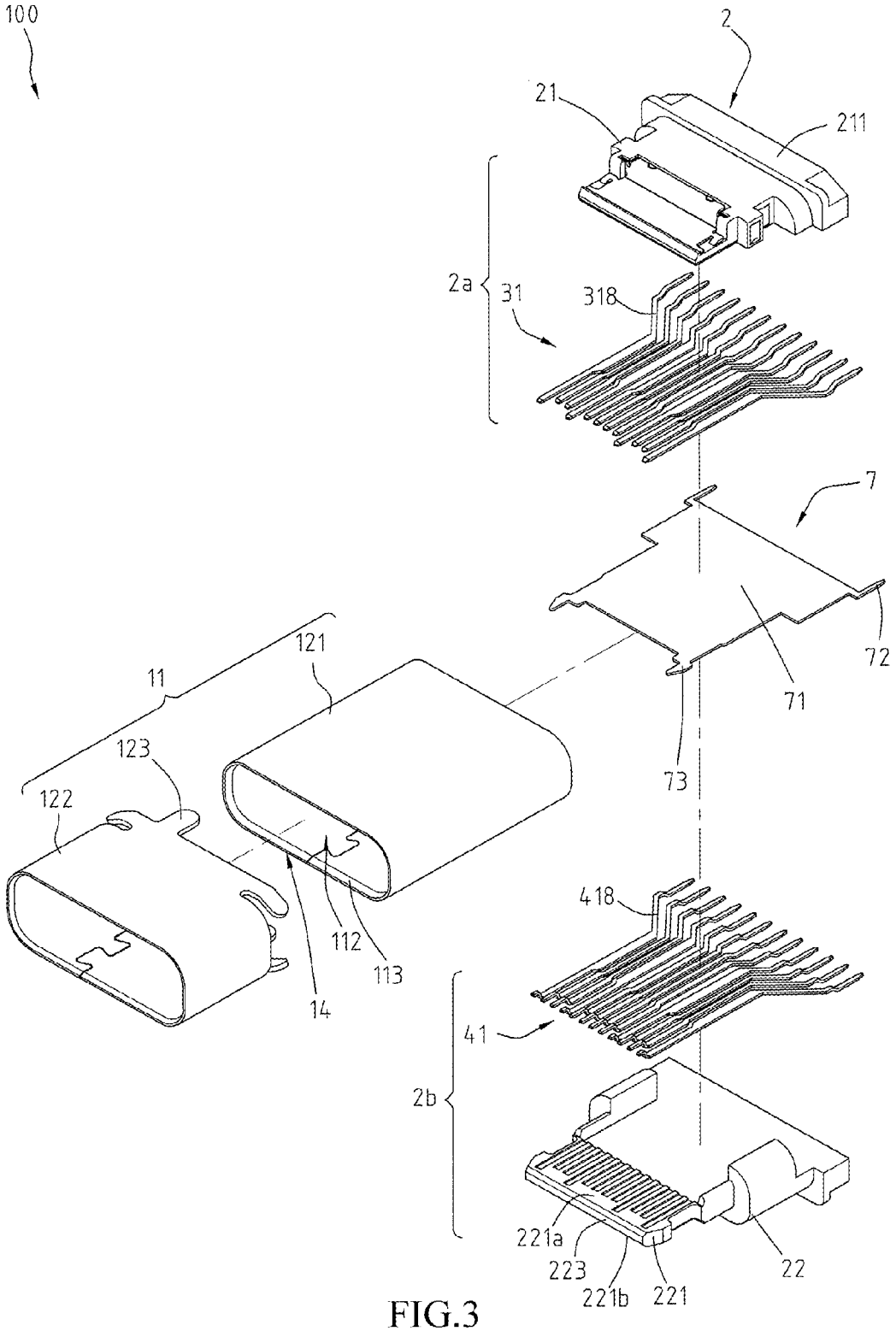
FIG. 3 illustrates an exploded view of the standing-type electrical receptacle connector.

Please refer to FIGS. 1 to 3, which illustrate a standing-type electrical receptacle connector 100 of an exemplary embodiment of the instant disclosure. FIG. 1 illustrates a perspective view from the front of the standing-type electrical receptacle connector 100. FIG. 2 illustrates a perspective view from the back of the standing-type electrical receptacle connector 100. FIG. 3 illustrates an exploded view of the standing-type electrical receptacle connector 100. The standing-type electrical receptacle connector 100 is soldered on a circuit board 5 by a standing manner; that is, the connecting direction of the standing-type electrical receptacle connector 100 is substantially perpendicular to the surface of the circuit board 5. In this embodiment, the standing-type electrical receptacle connector 100 can provide a reversible or dual orientation USB Type-C connector interface and pin assignments, i.e., a USB Type-C receptacle connector. In this embodiment, the standing-type electrical receptacle connector 100 comprises a metallic shell 11, a terminal seat 2, and a grounding plate 7.

Figure 5:
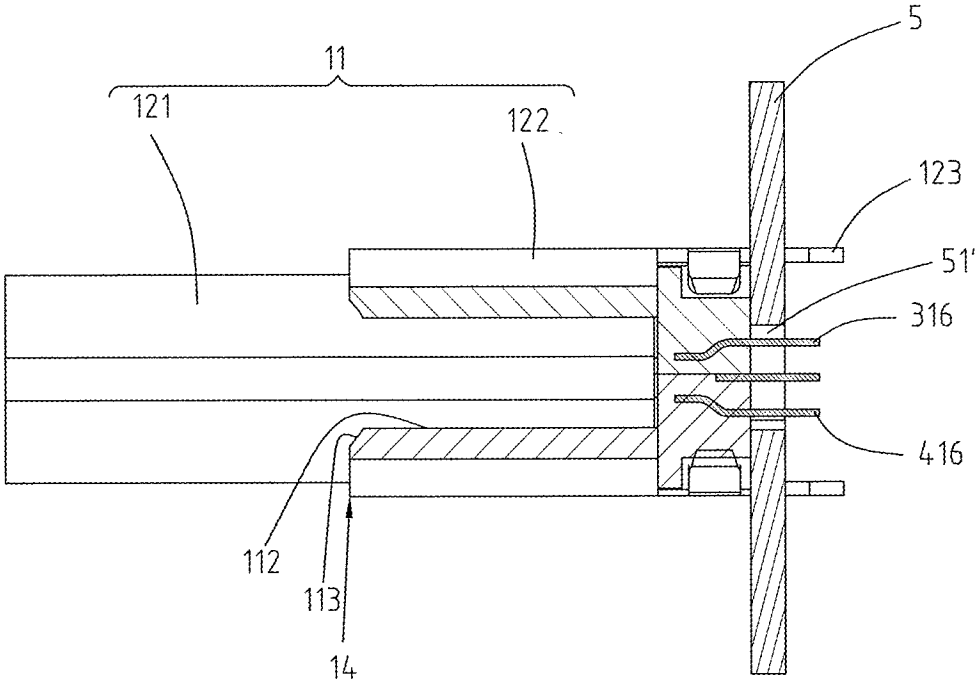
FIG. 5 illustrates a lateral sectional view of the standing-type electrical receptacle connector.

Please refer to FIGS. 1, 3, and 5. The metallic shell 11 is a hollowed shell, and the metallic shell 11 comprises a receptacle cavity 112. In addition, the metallic shell 11 may be a tubular member 14. In this embodiment, the metallic shell 11 may be formed by a multi-piece member. The metallic shell 11 comprises an inner shell 121 and a cover plate 122, and the inner shell 11 encloses the first insulated member 212. The cover plate 122 is a hollowed shell and covers the rear of the inner shell 121. In addition, the cover plate 122 comprises a plurality of fixing pieces 123 extending from the rear thereof for soldering with the circuit board 5, but embodiments are not limited thereto. In some embodiments, the metallic shell 11 is a unitary member and only comprises the inner shell 121. In addition, the inner shell 121 comprises a plurality of fixing pieces 123 extending from the rear thereof for soldering with the circuit board 5. Accordingly, the cost for manufacturing the cover plate 122 can be saved. In addition, an insertion opening 113 with oblong shaped is formed at one side of the metallic shell 11, the insertion opening 113 is for being inserted by an electrical plug connector, and the insertion opening 113 communicates with the receptacle cavity 112.

Figure 4:
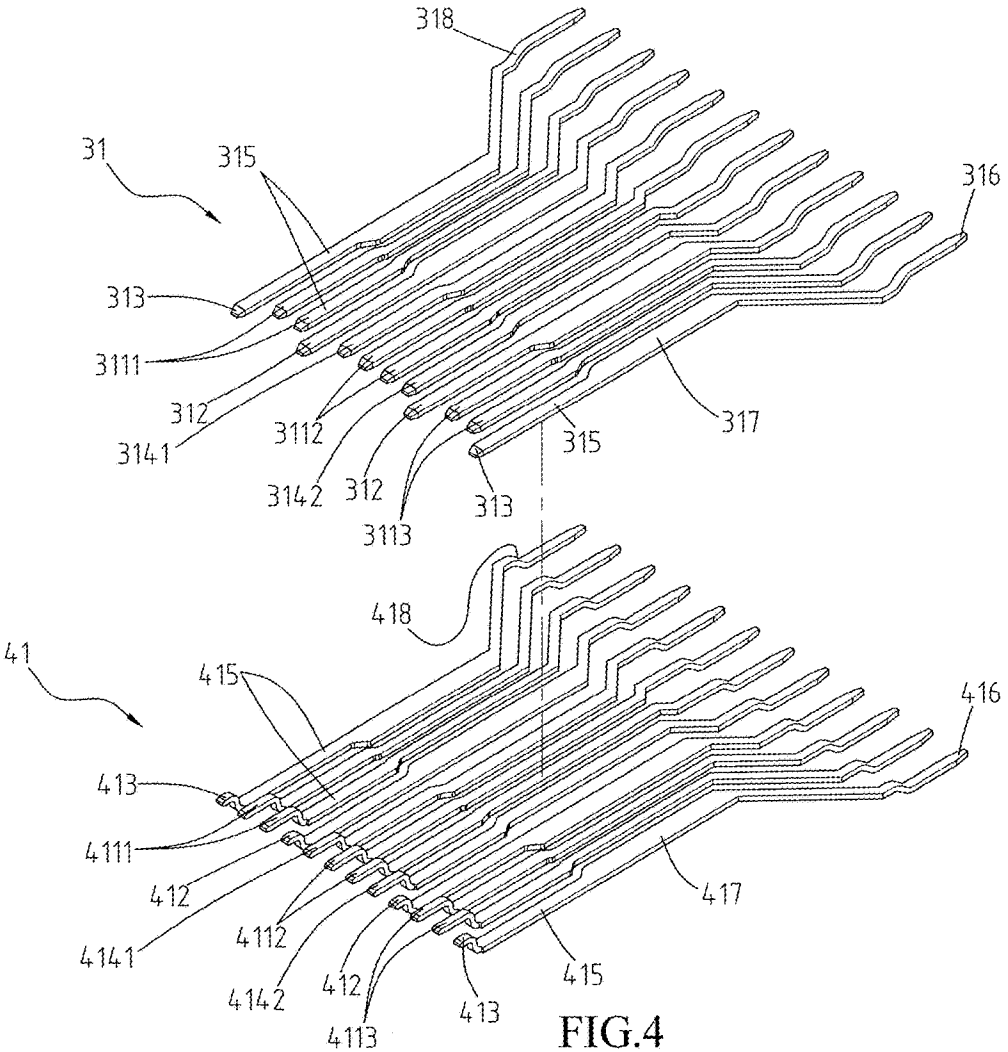
FIG. 4 illustrates a perspective view of first receptacle terminals and second receptacle terminals of the standing-type electrical receptacle connector.

Please refer to FIGS. 3 to 5. The terminal seat 2 comprises a first terminal module 2*a* and a second terminal module 2*b*. In this embodiment, the first terminal module 2*a* is received in the receptacle cavity 112 of the metallic shell 11. The first terminal module 2*a* comprises a first insulated member 21 and a plurality of first receptacle terminals 31. The first receptacle terminals 31 are held at the first insulated member 21. The first receptacle terminals 31 comprise a plurality of ground terminals 313, and each of the ground terminals 313 comprises a tail portion 316. The tail portions 316 of the ground terminals 313 are extending out of the rear of the first insulated member 21.

Figure 6:
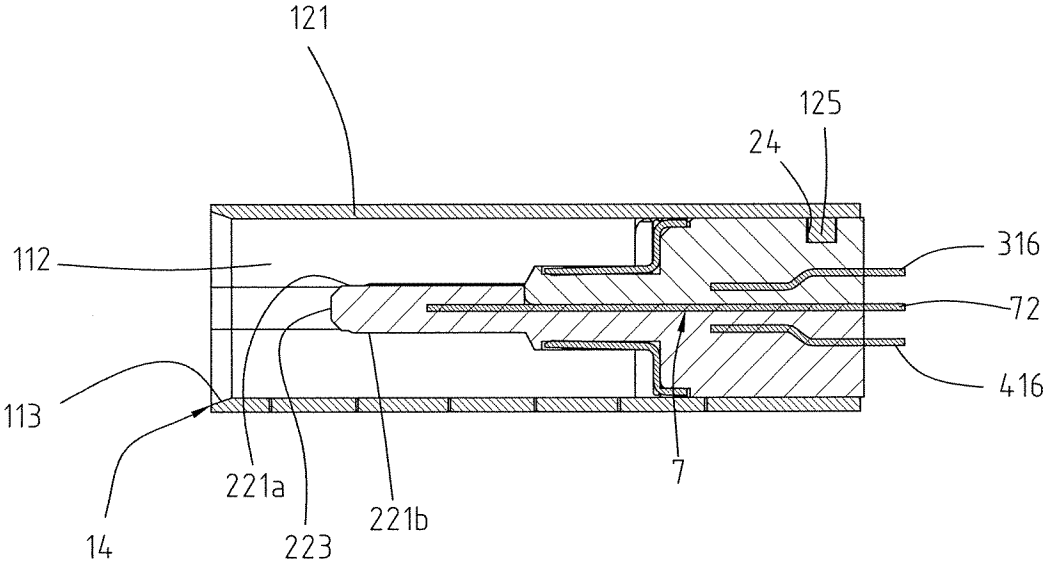
FIG. 6 illustrates a lateral sectional view of the standing-type electrical receptacle connector in which a cover plate is not shown.

Please refer to FIGS. 3 to 5. In this embodiment, the first terminal module 2*a* comprises a rear block 211 extending from the rear of the first insulated member 21 and abutted against the periphery of the metallic shell 11. In addition, several extension plates are extending from two sides of the rear of the cover plate 122 to be engaged with the rear block 211. Therefore, the cover plate 122 can be firmly assembled with the first insulated member 21. Furthermore, in some embodiments, the first terminal module 2*a* may not comprise the rear block 211, and the first insulated member 21 is directly assembled in the inner shell 121. In addition, as shown in FIG. 6, the inner wall of the inner shell 121 may comprise a buckling sheet 125 protruding therefrom, and the terminal seat 2 may comprise a recessed portion 24, so that when the terminal seat 2 is assembled in the inner shell 121, the buckling sheet 125 is engaged with the recessed portion 24. Accordingly, the terminal seat 2 can be firmly positioned with the metallic shell 11.

Figures 9A, 9B, 9C, 9D:
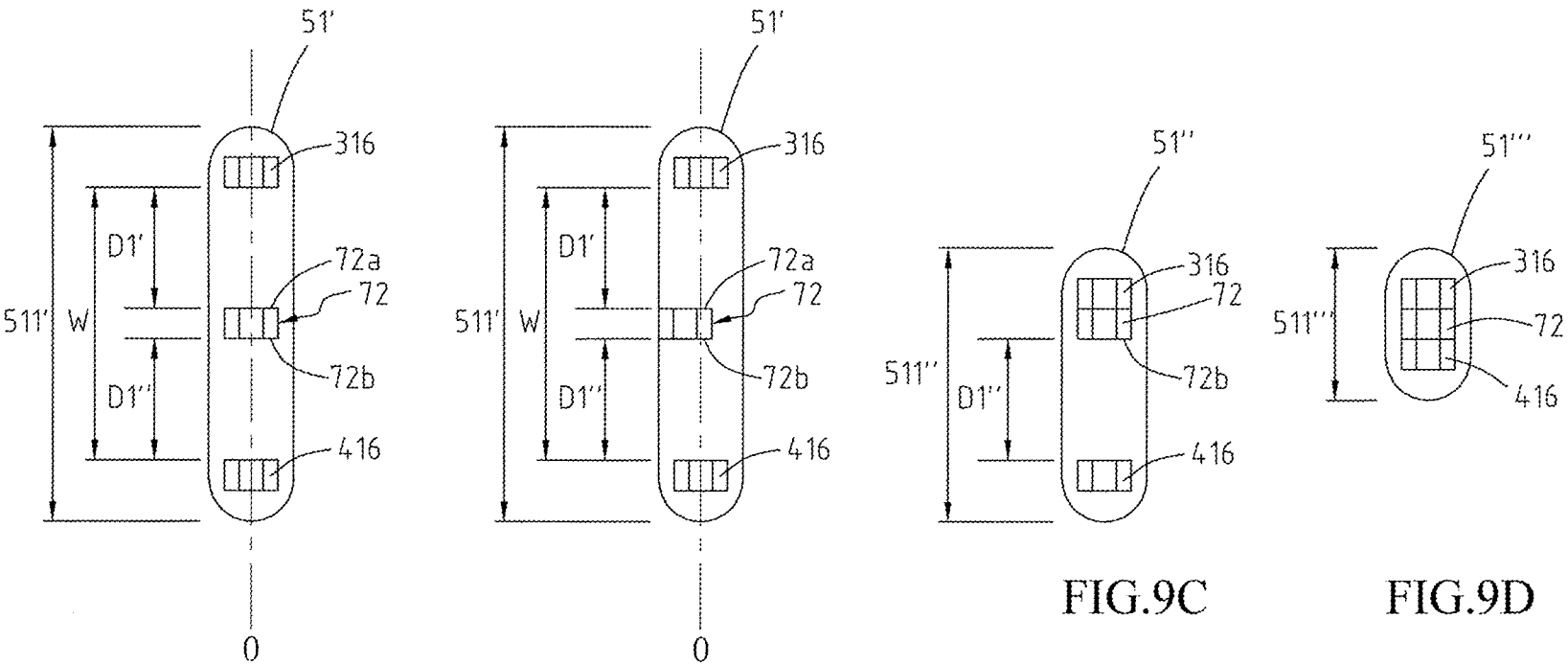
FIG. 9A illustrates a partial enlarged view showing that an embodiment of a first receptacle terminal, a second receptacle terminal, and a leg of a grounding plate of the standing-type electrical receptacle connector are inserted into the same grounding solder hole of a circuit board.
FIG. 9B illustrates a partial enlarged view (1) showing that another embodiment of a first receptacle terminal, a second receptacle terminal, and a leg of a grounding plate of the standing-type electrical receptacle connector are inserted into the same grounding solder hole of a circuit board.
FIG. 9C illustrates a partial enlarged view (2) showing that another embodiment of a first receptacle terminal, a second receptacle terminal, and a leg of a grounding plate of the standing-type electrical receptacle connector are inserted into the same grounding solder hole of a circuit board.
FIG. 9D illustrates a partial enlarged view (3) showing that another embodiment of a first receptacle terminal, a second receptacle terminal, and a leg of a grounding plate of the standing-type electrical receptacle connector are inserted into the same grounding solder hole of a circuit board.

Please refer to FIGS. 3 to 5. The second terminal module 2*b* is received in the receptacle cavity 112 of the metallic shell 11. The second terminal module 2*b* is combined with the first terminal module 2*a*. The second terminal module 2*b* comprises a second insulated member 22 and a plurality of second receptacle terminals 41. The second receptacle terminals 41 are held at the second insulated member 22. The second receptacle terminals 41 comprise a plurality of ground terminals 413, and each of the ground terminals 413 comprises a tail portion 416. The tail portions 416 of the ground terminals 413 are extending out of the rear of the second insulated member 22. Moreover, an assembling space W is formed between the tail portion 316 of each of the ground terminals 313 and the tail portion 416 of the corresponding ground terminal 413, as shown in FIG. 9A. The assembling space W means, the space between the tail portion 316 of each of the ground terminals 313 and the tail portion 416 of the corresponding ground terminal 413 is only for assembling a leg 72 of the grounding plate 7.

Figure 10:
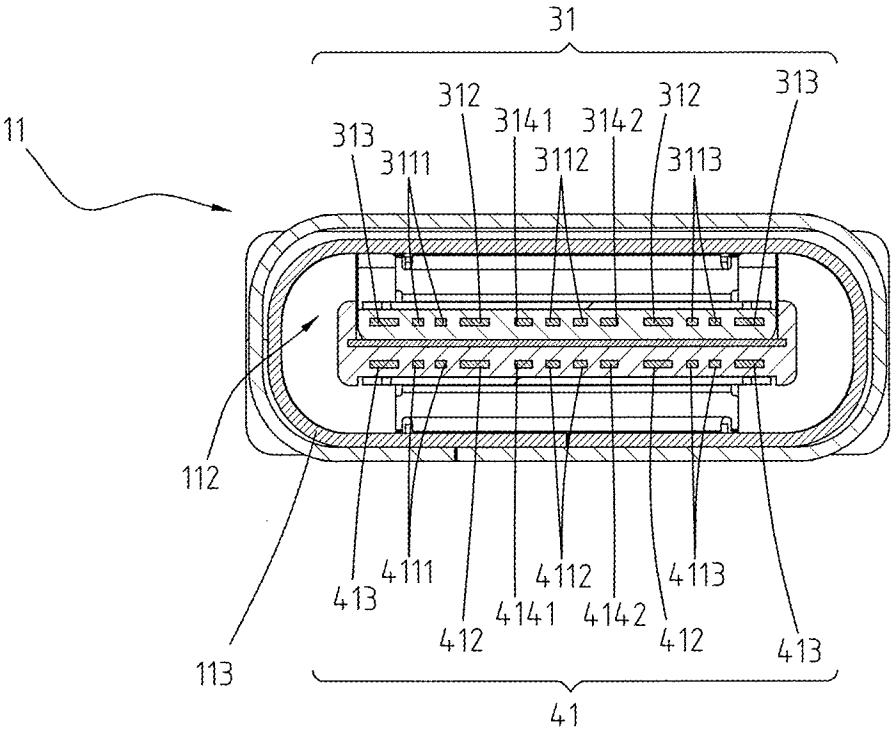
FIG. 10 illustrates a front sectional view of the standing-type electrical receptacle connector.

Please refer to FIGS. 3, 6, and 10. In this embodiment, the terminal seat 2 comprises a tongue portion 221 extending from one end of the second insulated member 22, but not from the first insulated member 21. Alternatively, two tongue portions may be respectively extending from the first insulated member 21 and the second insulated member 22, the two tongue portions are stacked with each other, and the grounding plate 7 is between the two tongue portions. In a further option, the tongue portion may be extending from one end of the first insulated member 21, but not from the second insulated member 22.

Please refer to FIGS. 3, 6, and 10. In this embodiment, the second insulated member 22 and the tongue portion 221 are manufactured by injection molding technique or the like, so that the second insulated member 22 and the tongue portion 221 are integrated with each other to form a one-piece member. In addition, the grounding plate 7 is buried in the second insulated member 22 and the tongue portion 221. In one embodiment, the first terminal module 2*a* and the second terminal module 2*b* are combined with each other by assembling, but embodiments are not limited thereto. In some embodiments, the first terminal module 2*a* and the second terminal module 2*b* may be formed by injection molding or the like for being adapted to different needs. In addition, the tongue portion 221 has two opposite surfaces, one is a first surface 221*a* (i.e., the upper surface), and the other is a second surface 221*b* (i.e., the lower surface). In addition, the front lateral surface 223 of the tongue portion 221 is connected the first surface 221*a* with the second surface 221*b* and is close to the insertion opening 113. In other words, the front lateral surface 223 is near to the insertion opening 113 and perpendicularly connected to the first surface 221*a* and the second surface 221*b*, respectively.

Please refer to FIGS. 3, 6, and 10. In this embodiment, the first receptacle terminals 31 and the first insulated member 21 are combined with each other by insert-molded techniques; likewise, the second receptacle terminals 41 and the second insulated member 22 are combined with each other by insert-molded techniques.

Please refer to FIGS. 3, 4, 10, and 11. The first receptacle terminals 31 comprise a plurality of first signal terminals 311, at least one power terminal 312, and a plurality of ground terminals 313. The first signal terminals 31 comprises a plurality of pairs of first high-speed signal terminals 3111/3113 and a pair of first low-speed signal terminals 3112. Referring to FIG. 11, the first receptacle terminals 31 comprise, from left to right, a ground terminal 313 (Gnd), a first pair of first high-speed signal terminals 3111 (TX1+–, differential signal terminals for high-speed signal transmission), a power terminal 312 (PowerNBUS), a first function detection terminal 3141 (CC1, a terminal for inserting orientation detection of the connector and for cable recognition), a pair of first low-speed signal terminals 3112 (D+–, differential signal terminals for low-speed signal transmission), a supplement terminal 3142 (SBU1, a terminal can be reserved for other purposes), another power terminal 312 (PowerNBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (PowerNBUS) and provided for power transmission. In this embodiment, the width of the power terminal 312 (PowerNBUS) may be, but not limited to, equal to the width of the first signal terminal 311. In some embodiments, the width of the power terminal 312 (Power/VBUS) may be greater than the width of the first signal terminal 311 and a standing-type electrical receptacle connector 100 having the power terminal 312 (PowerNBUS) can be provided for large current transmission.

Please refer to FIGS. 3, 4, 10, and 11. The first receptacle terminals 31 are held in the first insulated member 21 and formed as the upper-row terminals of the standing-type electrical receptacle connector 100. Each of the first receptacle terminals 31 comprises a flat contact portion 315, a body portion 317, and a tail portion 316. For each of the first receptacle terminals 31, the body portion 317 is held in the first insulated member 21, the flat contact portion 315 is extending forward from the body portion 317 in the rear-to-front direction and partly exposed upon the first surface 221*a* of the tongue portion 221, and the tail portion 316 is extending backward from the body portion 317 in the front-to-rear direction and protruding from the rear of the first insulated member 21. The first signal terminals 311 are disposed at the first surface 221*a* and transmit first signals (namely, USB 3.0 signals). The tail portions 316 are extending horizontally from the body portions 317 to form vertical legs (with respect to the insertion direction of the circuit board 5), named through-hole legs, that are inserted into holes drilled in a printed circuit board by using through-hole technology. In addition, the width across all of the tail portions 316 is greater than the width across all of the body portions 317. Therefore, the tail portion 316 and the body portion 317 of each of the first receptacle terminals 31 are not aligned along the same line, and the distance between two adjacent tail portions 316 correspond the distance between two adjacent soldering holes of the circuit board 5.

Figure 7B:
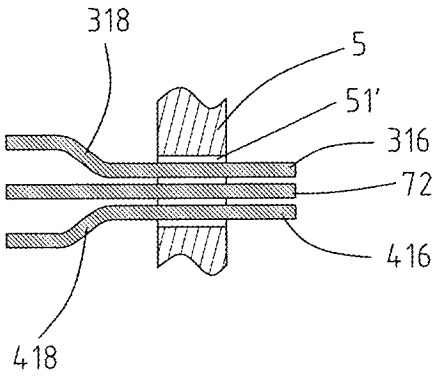
FIG. 7B illustrates a sectional view showing that another embodiment of a first receptacle terminal, a second receptacle terminal, and a leg of a grounding plate of the standing-type electrical receptacle connector are inserted into the same grounding solder hole of a circuit board.
Figure 7A:
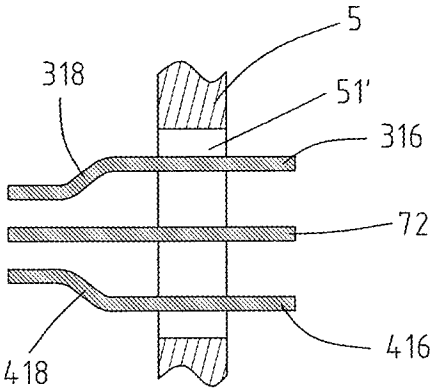
FIG. 7A illustrates a sectional view showing that an embodiment of a first receptacle terminal, a second receptacle terminal, and a leg of a grounding plate of the standing-type electrical receptacle connector are inserted into the same grounding solder hole of a circuit board.

Please refer to FIGS. 3, 4, and 7A. In this embodiment, the first receptacle terminals 31 further comprise a plurality of bending portions 318. Each of the bending portions 318 is extending between the corresponding tail portion 316 and the corresponding body portion 317, so that the distance between the tail portion 316 of each of the ground terminals 313 and the corresponding leg 72 of the grounding plate 7 can be widened. In other words, the bending portions 318 are extending toward a direction away from the grounding plate 7, so that the distance between the tail portion 316 of each of the ground terminals 313 and the corresponding leg 72 of the grounding plate 7 can be adjusted. In some embodiments, the bending portions 318 may be extending toward the grounding plate 7 (as shown in FIG. 7B), so that the tail portion 316 of each of the ground terminals 313 can be drawn close with the corresponding leg 72. Specifically, the tail portions 316 of the ground terminals 313 are respectively drawn close with the legs 72 at two sides of the grounding plate 7. Here, the term "drawn close" means that the components may be in contact with each other (as shown in FIG. 9D) or spaced apart from each other by a distance D1' (as shown in FIG. 9A).

Please refer to FIGS. 3, 4, 10, and 11. The second receptacle terminals 41 comprise a plurality of second signal terminals 411, at least one power terminal 412, and a plurality of ground terminals 413. The second receptacle terminals 41 comprise a plurality of pairs of second high-speed signal terminals 4111/4113 and a pair of second low-speed signal terminals 4112. Referring to FIG. 11, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (PowerNBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (PowerNBUS), a second pair of second high-speed signal terminals 4113 (RX1+−, differential signal terminals for high-speed signal transmission), and another ground terminal 413 (Gnd). Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and a standing-type electrical receptacle connector 100 having the power terminal 412 (Power/VBUS) can be provided for large current transmission.

Please refer to FIGS. 3, 4, 10, and 11. The second receptacle terminals 41 are held in the second insulated member 11 and formed as the lower-row terminals of the standing-type electrical receptacle connector 100. In addition, the first receptacle terminals 31 are substantially aligned parallel with the second receptacle terminals 41. Each of the second receptacle terminals 41 comprises a flat contact portion 415, a body portion 417, and a tail portion 416. For each of the second receptacle terminals 41, the body portion 417 is held in the second insulated member 22 and the tongue portion 221, the flat contact portion 415 is extending from the body portion 417 in the rear-to-front direction and partly exposed upon the second surface 221*b* of the tongue portion 221, and the tail portion 416 is extending backward from the body portion 417 in the front-to-rear direction and protruding from the rear of the second insulated member 22. The second signal terminals 411 are disposed at the second surface 221*b* and transmit second signals (i.e., USB 3.0 signals). The tail portions 416 are extending horizontally from the body portions 417 to form vertical legs (with respect to the insertion direction of the circuit board 5), named through-hole legs, that are inserted into holes drilled in a printed circuit board by using through-hole technology. In addition, each of the tail portions 416 is obliquely extending to the corresponding body portion 417, so that the distance between two adjacent tail portions 416 can be widened. Accordingly, the width across all of the tail portions 416 is greater than the width across all of the body portions 417. Therefore, the tail portion 416 and the body portion 417 of each of the second receptacle terminals 41 are not aligned along the same line, and the distance between two adjacent tail portions 416 corresponds to the distance between two adjacent soldering holes of the circuit board 5.

Please refer to FIGS. 3, 4, and 7A. In this embodiment, the second receptacle terminals 41 further comprise a plurality of bending portions 418. Each of the bending portions 418 is extending between the corresponding tail portion 416 and the corresponding body portion 417, so that the distance between the tail portion 416 of each of the ground terminals 413 and the corresponding leg 72 of the grounding plate 7 can be widened. In other words, the bending portions 418 are extending toward a direction away from the grounding plate 7, so that the distance between the tail portion 416 of each of the ground terminals 413 and the corresponding leg 72 of the grounding plate 7 can be adjusted. Specifically, the distance between the tail portion 316 of each of the ground terminals 313 and the corresponding leg 72 of the grounding plate 7 is equal to the distance between the tail portion 416 of the corresponding ground terminal 413 and the leg 72 of the grounding plate 7, but embodiments are not limited thereto. In some embodiments, the bending portions 418 may be extending toward the grounding plate 7 (as shown in FIG. 7B), so that the tail portion 416 of each of the ground terminals 413 can be drawn close with the leg 72. Specifically, the tail portions 416 of the ground terminals 413 are respectively drawn close with the legs 72 at two sides of the grounding plate 7. Here, the term "drawn close" means that the components may be in contact with each other (as shown in FIG. 9D) or spaced apart from each other by a distance D1" (as shown in FIG. 9A). In addition, the distance between the tail portion 316 of each of the ground terminals 313 and the corresponding leg 72 may be equal to the distance between the tail portion 416 of the corresponding ground terminal 413 and the leg 72.

The crosstalk interference can be reduced by the shielding of the grounding plate 7 when the flat contact portions 315, 415 transmit signals. Furthermore, the structural strength of the tongue portion 221 can be improved by the assembly of the grounding plate 7. In addition, the legs 72 of the grounding plate 7 are exposed from the second insulated member 22 and in contact with the circuit board 5 for conduction and grounding.

Please refer to FIGS. 3, 6, and 10. The grounding plate 7 is between the first terminal module 2*a* and the second terminal module 2*b*. The grounding plate 7 comprises a plate body 71 and a plurality of legs 72. The plate body 71 is between the first receptacle terminals 31 and the second receptacle terminals 41, i.e., the plate body 71 is held at the second insulated member 22, and the plate body 71 is between the flat contact portions 315 of the first receptacle terminals 31 and the flat contact portions 415 of the second receptacle terminals 41. The plate body 71 is assembled on the surface of the second insulated member 22. The plate body 71 is lengthened and widened, so that the front of the plate body 71 is near to the front lateral surface 223 of the tongue portion 221, two sides of the plate body 71 is near to two sides of the tongue portion 221, and the rear of the plate body 71 is near to the rear of the second insulated member 22. Accordingly, the plate body 71 can be disposed on the tongue portion 221 and the second insulated member 22, and the structural strength of the tongue portion 221 and the shielding performance of the tongue portion 221 can be improved.

Please refer to FIGS. 3, 4, 5, 7A, and 9A. The legs 72 of the grounding plate 7 are respectively extending from two sides of the rear of the plate body 71 and extending out of the rear of the second insulated member 22. The legs 72 are positioned in the assembling space W. In other words, each of the legs 72 is disposed between the corresponding tail portion 316 and the corresponding tail portion 416; namely, each of the legs 72 is disposed between the tail portion 316 of the corresponding ground terminal 313 and the tail portion 416 of the corresponding ground terminal 413. In addition, a first leg surface 72*a* of each of the legs 72 is adjacent to the tail portion 316 of the corresponding ground terminal 313; specifically, the space (if have) between the leg 72 and the tail portion 316 is free of other components or structures. Likewise, a second leg surface 72*b* of each of the legs 72 is adjacent to the tail portion 416 of the corresponding ground terminal 413; specifically, the space (if have) between the leg 72 and the tail portion 416 is free of other components or structures. Moreover, as shown from the rear of the standing-type electrical receptacle connector 100, a cross section portion of each of the legs 72, a cross section portion of the tail portion 316 of the corresponding ground terminal 313, and a cross section portion of the tail portion 416 of the corresponding ground terminal 413 are aligned along a vertical line O and overlapped with each other. The term "overlap" means that, from a top view, each of the legs 72, the tail portion 316 of the corresponding ground terminal 313, and the tail portion 416 of the corresponding ground terminal 413 are aligned with each other, with or without spaces therebetween. When the legs 72 and the tail portions 316, 416 of the corresponding ground terminals 313, 413 have the same width, the edges of the legs 72 and the edges of the tail portions 316, 416 are aligned with each other. Accordingly, such overlapped configuration allows the diameter 511' of the ground soldering hole 51' for being inserted by the leg 72 and the tail portions 316, 416 can be reduced. In other words, the diameter 511' of the ground soldering hole 51' may be slightly greater than the overall width of the leg 72 and the tail portions 316, 416. Therefore, the space on the circuit board 5 for drilling holes can be reduced, and available spaces on the circuit board 5 for other purposes can be increased; that is, the available spaces on the circuit board 5 for layout or wiring can be increased.

Figure 8:
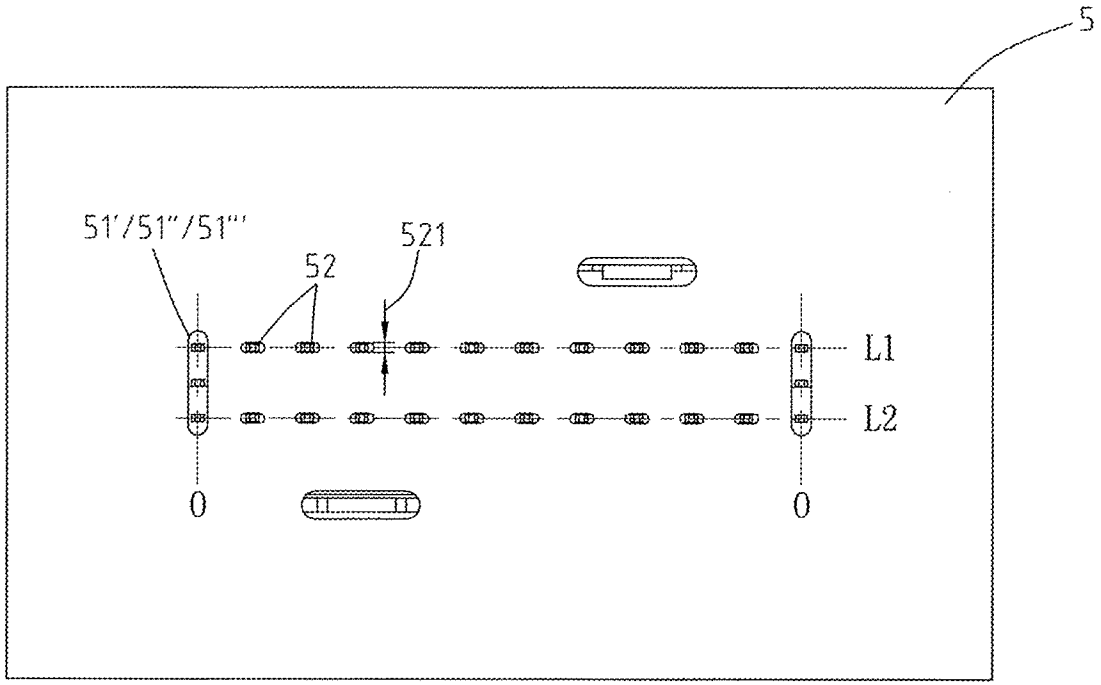
FIG. 8 illustrates a top view of the circuit board in which the receptacle terminals and the legs being inserted into the soldering holes.

Please refer to FIGS. 3 and 8. From the rear of the standing-type electrical receptacle connector 100, the tail portions 316 of the first signal terminals 311, the tail portion 316 of the power terminal 312, and the tail portions 316 of the ground terminals 313 are aligned along a first horizontal line L1. Likewise, the tail portions 416 of the second signal terminals 411, the tail portion 416 of the power terminal 412, and the tail portions 416 of the ground terminals 413 are aligned along a second horizontal line L2. The vertical line O along which the legs 72, the tail portions 316 of the ground terminals 313, and the tail portions 416 of the ground terminals 413 are aligned is substantially perpendicular to the first horizontal line L1 and the second horizontal line L2.

Please refer to FIG. 3, in which the grounding plate 7 further comprises a plurality of hooks 73. The plate body 71 is between the flat contact portions 315 of the first receptacle terminals 31 and the flat contact portions 415 of the second receptacle terminals 41. The hooks 73 are extending outward from two sides of the front of the plate body 71 and protruding out of the front lateral surface 223 and two sides of the tongue portion 221. When an electrical plug connector is mated with the standing-type electrical receptacle connector 100, elastic pieces at two sides of an insulated housing of the electrical plug connector are engaged with the hooks 73, and the elastic pieces would not wear against the tongue portion 221 of the standing-type electrical receptacle connector 100. Hence, the grounding plate 7 can be in contact with the metallic shell 11 for conduction and grounding.

In addition, in the forgoing embodiments, the widths of the leg 72, the tail portions 316, and the tail portions 416 are the same, and the edges of the legs 72 and the edges of the tail portions 316, 416 are aligned with each other, but embodiments are not limited thereto. Please refer to FIG. 9B. In some embodiments, the cross section portion of each of the legs 72, the cross section portion of the tail portion 316 of the corresponding ground terminal 313, and the cross section portion of the tail portion 416 of the corresponding ground terminal 413 are aligned along the vertical line O, but unaligned with each other. In addition, the widths of the leg 72, the tail portions 316, and the tail portions 416 may be different. Moreover, the position of each of the legs 72 and the positions of the tail portions 316, 416 of the corresponding ground terminals 313, 413 can be different. For example, in this embodiment, the cross section portion of each of the legs 72 and the cross section portions of the tail portions 316, 416 of the corresponding ground terminals 313, 413 are aligned along the vertical line O, but embodiments are not limited thereto. The cross section portion of each of the legs 72 and the cross section portions of the tail portions 316, 416 of the corresponding ground terminals 313, 413 may be aligned along a transversal line or a slant line. Furthermore, the leg 72 (or the tail portion 316/416) may be shifted leftward or rightward, so that the leg 72 and the tail portions 316, 416 are partially overlapped with each other. In other words, the center of the cross section portion of the each of the legs 72, the center of the cross section portion of the tail portion 316 of the corresponding ground terminal 313, and the center of the cross section portion of the tail portion 416 of the corresponding ground terminal 13 are not aligned with each other, so that the edges of the legs 72 and the edges of the tail portions 316, 416 are not aligned with each other, i.e., aligned by an offset. In this configuration, each of the legs 72, the tail portion 316 of the corresponding ground terminal 313, and the tail portion 416 of the corresponding ground terminal 413 can also be inserted into the same ground soldering hole 51' for soldering with the circuit board 5. In addition, in this embodiment, the cross section portion of each of the legs 72, the cross section portion of the tail portion 316 of the corresponding ground terminal 313, and the cross section portion of the tail portion 416 of the corresponding ground terminal 413 are rectangular shaped, but may be other geometrical shapes, like a round shape.

Please refer to FIG. 9A. In this embodiment, from a lateral sectional view of the standing-type electrical receptacle connector 100, a surface of each of the tail portions 316 is spaced from the first leg surface 72*a* of the corresponding leg 72 by a distance D1'. In addition, a surface of each of the tail portions 416 is spaced from the second leg surface 72*b* of the corresponding leg 72 by a distance D1". The distance D1' is equal to the distance D1". Therefore, each of the legs 72, the corresponding tail portion 316, and the corresponding tail portion 416 are inserted into the same ground soldering hole 51'. Therefore, the number of the soldering holes of the circuit board 5 can be reduced. In this embodiment, the number of the soldering holes of the circuit board 5 is less than that of a conventional circuit board. In other words, the number of the soldering holes of the circuit board equals to the number of the soldering pins (i.e., the legs and the tail portions) in the conventional; while in this embodiment, several soldering pins may be inserted into the same soldering hole. Accordingly, the cost for soldering procedure can be reduced.

In some embodiments, from a lateral sectional view of the standing-type electrical receptacle connector 100, the distance D1' between the surface of each of the tail portions 316 and the first leg surface 72*a* of the corresponding leg 72 may be less than the distance D1" between the surface of each of the tail portions 416 and the second leg surface 72*b* of the corresponding leg 72. Alternatively, the distance D1' between the surface of each of the tail portions 316 and the first leg surface 72*a* of the corresponding leg 72 may be greater than the distance D1" between the surface of each of the tail portions 416 and the second leg surface 72*b* of the corresponding leg 72.

Please refer to FIG. 9C. In some embodiments, from a lateral sectional view of the standing-type electrical receptacle connector 100, the surface of each of the tail portions 316 is in contact with the first leg surface 72*a* of the corresponding leg 72, and the surface of each of the tail portions 416 is spaced from the second leg surface 72*b* of the corresponding leg 72 by the distance D1". Therefore, the diameter 511" of the ground soldering hole 51" in this embodiment is less than the diameter 511' of the ground soldering hole 51' in the foregoing embodiment (where the leg 72 is spaced from the tail portions 316, 416 by the distances D1' and D1", respectively). Alternatively, the surface of each of the tail portions 316 is in contact with the first leg surface 72*a* of the corresponding leg 72, and the surface of each of the tail portions 416 is in contact with the second leg surface 72*b* of the corresponding leg 72. Therefore, the diameter 511'" of the ground soldering hole 51'" in this embodiment is further less than the diameter 511" of the ground soldering hole 51" (where the leg 72 is in contact with the tail portion 316 and spaced from the tail portion 416 by the distance D1"). Accordingly, the space of the circuit board 5 for drilling can be further reduced, and the available area of the circuit board 5 can further increase.

Please refer to FIGS. 5, 7A, and 8. The standing-type electrical receptacle connector 100 further comprises the circuit board 5. The circuit board 5 comprises a plurality of ground soldering holes 51' and a plurality of terminal soldering holes 52. The ground soldering holes 51' and the terminal soldering holes 52 are formed on the circuit board 5. The diameter 511' of each of the ground soldering holes 51' is greater than the diameter 521 of each of the terminal soldering holes 52. That is, the diameter 511' of the ground soldering hole 51' allows the insertion of several soldering pins; in this embodiment, one tail portion 316 of the ground terminal 313, one tail portion 416 of the ground terminal 413, and one leg 72 are inserted into the ground soldering hole 51'. Conversely, the diameter 521 of the terminal soldering hole 52 allows the insertion of one soldering pin; in this embodiment, the tail portion 316 of each of the first signal terminals 311, the tail portion 316 of the power terminal 312, the tail portion 416 of each of the second signal terminals 411, and the tail portion 416 of the power terminal 412 are respectively inserted into the terminal soldering holes 52.

Please refer to FIGS. 3, 4, and 10. In this embodiment, the first receptacle terminals 31 and the second receptacle terminals 41 are held at the first surface 221*a* and the second surface 221*b* of the tongue portion 221; which may be, the first receptacle terminals 31 are held at the first surface 221*a* of the tongue portion 221 and the second receptacle terminals 41 are held at the second surface 221*b* of the tongue portion 221, or the first receptacle terminals 31 are held at the second surface 221*b* of the tongue portion 221 and the second receptacle terminals 41 are held at the first surface 221*a* of the tongue portion 221. Specifically, each pair of the first high-speed signal terminals 3111/3113 are spaced from the corresponding pair of the second high-speed signal terminals 4111/4113 by a uniform interval. Therefore, the signal interference problem between each pair of the first high-speed signal terminals 3111/3113 and the corresponding pair of the second high-speed signal terminals 4111/4113 can be prevented and improved.

Please refer to FIGS. 3, 10, and 11. Pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180 degree symmetrical design with respect to the central point of the receptacle cavity 112 as the symmetrical center. The dual or double orientation design enables an electrical plug connector to be inserted into the standing-type electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the standing-type electrical receptacle connector 100 with a first orientation where the first surface 221*a* is facing up, for transmitting first signals. Conversely, the electrical plug connector is inserted into the standing-type electrical receptacle connector 100 with a second orientation where the first surface 221*a* is facing down, for transmitting second signals. Furthermore, the specification for transmitting the first signals is conformed to the specification for transmitting the second signals. Note that, the inserting orientation of the electrical plug connector is not limited by the standing-type electrical receptacle connector 100 according embodiments of the instant disclosure.

Additionally, in some embodiments, the standing-type electrical receptacle connector 100 is devoid of the first receptacle terminals 31 (or the second receptacle terminals 41) when an electrical plug connector to be mated with the standing-type electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the standing-type electrical receptacle connector 100 when the electrical plug connector is inserted into the standing-type electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the standing-type electrical receptacle connector 100 when the electrical plug connector is inserted into the standing-type electrical receptacle connector 100 with the dual orientations.

Please refer to FIGS. 3 and 10. In this embodiment, as viewed from the front of the receptacle terminals 31, 41, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the standing-type electrical receptacle connector 100 have the offset alignment, plug terminals of an electrical plug connector to be mated with the standing-type electrical receptacle connector 100 would also have the offset alignment. Hence, the plug terminals of the electrical plug connector can be in contact with the receptacle terminals 31, 41 of the standing-type electrical receptacle connector 100 for power or signal transmission.

Please refer to FIG. 3. In this embodiment, the standing-type electrical receptacle connector 100 further comprises a plurality of conductive sheets. The conductive sheets are metal elongated plates and may comprise an upper conductive sheet and a lower conductive sheet. The upper conductive sheet is assembled on the upper portion of the first insulated member 21, and the lower conductive sheet is assembled on the lower portion of the second insulated member 22. When an electrical plug connector is mated with the standing-type electrical receptacle connector 100, the front of a metallic shell of the electrical plug connector is in contact with the conductive sheets, the metallic shell of the electrical plug connector is efficiently in contact with the metallic shell 11 of the standing-type electrical receptacle connector 100 via the conductive sheets, and the electromagnetic interference (EMI) problem can be improved.

Based on the above, the tail portion of the ground terminal of the first receptacle terminal, the tail portion of the ground terminal of the second receptacle terminal, and the leg of the grounding plate are adjacent to and drawn close with each other, so that the tail portions and the leg can be inserted into the same ground soldering hole for soldering with the circuit board. Accordingly, the manufacturing of the circuit board can be simplified, and the cost for soldering procedure can be reduced. Moreover, the rear block extending from the rear of the second insulated member can be engaged with the cover plate, so that the cover plate can be positioned with the first insulated member as well as the second insulated member. Additionally, the rear block and the cover plate may be omitted in some embodiments, and the first insulated member and the second insulated member are directly assembled in the inner shell of the metallic shell. Therefore, the manufacturing cost of the connector can be reduced, and the connector can be adapted to different needs.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the standing-type electrical receptacle connector can have a 180 degree symmetrical, dual or double orientation design and pin assignments which enables the standing-type electrical receptacle connector to be mated with a corresponding plug connector in either of two intuitive orientations, i.e. in either upside-up or upside-down directions. Therefore, when an electrical plug connector is inserted into the standing-type electrical receptacle connector with a first orientation, the flat contact portions of the first receptacle terminals are in contact with upper-row plug terminals of the electrical plug connector. Conversely, when the electrical plug connector is inserted into the standing-type electrical receptacle connector with a second orientation, the flat contact portions of the second receptacle terminals are in contact with the upper-row plug terminals of the electrical plug connector. Note that, the inserting orientation of the electrical plug connector is not limited by the standing-type electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A standing-type electrical receptacle connector, comprising:

a metallic shell comprising a receptacle cavity;

a first terminal module, received in the receptacle cavity of the metallic shell, wherein the first terminal module comprises a first insulated member and a plurality of first receptacle terminals, wherein the first receptacle terminals are held at the first insulated member and at least comprise a plurality of first ground terminals each having a first tail portion, and wherein the first tail portions of the first ground terminals are extending out of the first insulated member;

a second terminal module, received in the receptacle cavity of the metallic shell and combined with the first terminal module, wherein the second terminal module comprises a second insulated member and a plurality of second receptacle terminals, wherein the second receptacle terminals are held at the second insulated member and at least comprise a plurality of second ground terminals each having a second tail portion, wherein the second tail portions of the second ground terminals are extending out of the second insulated member, and wherein an assembling space is formed between each of the first tail portions and the corresponding second tail portion; and a grounding plate between the first terminal module and the second terminal module, wherein the grounding plate comprises a plate body and a plurality of legs, the plate body is between the first receptacle terminals and the second receptacle terminals, the legs are extending outward from a rear of the plate body and extending out of the second insulated member, each of the legs is positioned in the corresponding assembling space, wherein a first leg surface of each of the legs is adjacent to the corresponding first tail portion, and a second leg surface of each of the legs is adjacent to the corresponding second tail portion, and wherein a cross section portion of each of the legs, a cross section portion of the corresponding first tail portion, and a cross section portion of the corresponding second tail portion are aligned along a vertical line.

2. The standing-type electrical receptacle connector according to claim 1, wherein a surface of each of the first tail portions is in contact with the first leg surface of the corresponding leg.

3. The standing-type electrical receptacle connector according to claim 1, wherein a surface of each of the second tail portions is in contact with the second leg surface of the corresponding leg.

4. The standing-type electrical receptacle connector according to claim 2, wherein a surface of each of the second tail portions is in contact with the second leg surface of the corresponding leg.

5. The standing-type electrical receptacle connector according to claim 1, wherein the surface of each of the first tail portions is spaced from the first leg surface of the corresponding leg by a distance.

6. The standing-type electrical receptacle connector according to claim 1, wherein the surface of each of the second tail portions is spaced from the second leg surface of the corresponding leg by a distance.

7. The standing-type electrical receptacle connector according to claim 1, further comprising a circuit board, wherein the circuit board comprises a plurality of ground soldering holes, each of the ground soldering holes is for the insertion of the corresponding first tail portion, the corresponding second tail portion, and the corresponding leg.

8. The standing-type electrical receptacle connector according to claim 7, wherein the metallic shell comprises an inner shell and a cover plate enclosing the inner shell, wherein the cover plate comprises a plurality of fixing pieces soldered with the circuit board.

9. The standing-type electrical receptacle connector according to claim 1, wherein the first terminal module comprises a rear block protruding from a rear of the first insulated member and abutted against a periphery of the metallic shell.

10. The standing-type electrical receptacle connector according to claim 1, wherein the second insulated member comprises a tongue portion, each of the first receptacle terminals comprises a first flat contact portion, each of the second receptacle terminals comprises a second flat contact portion, the tongue portion has two opposite surfaces, and the first flat contact portions and the second flat contact portions are respectively disposed at the two surfaces of the tongue portion.

11. The standing-type electrical receptacle connector according to claim 1, wherein the first receptacle terminals further comprise a plurality of first signal terminals and at least one first power terminal, the second receptacle terminals further comprise a plurality of second signal terminals and at least one second power terminal, wherein the tail portions of the first signal terminals, the tail portion of the first power terminal, and the tail portions of the first ground terminals are aligned along a first horizontal line, the tail portions of the second signal terminals, the tail portion of the second power terminal, and the tail portions of the second ground terminals are aligned along a second horizontal line, and the vertical line along where the legs, the first tail portions of the first ground terminals, and the second tail portions of the second ground terminals are aligned is substantially perpendicular to the first horizontal line and the second horizontal line.

* * * * *